United States Patent [19]

Hatzinikolas et al.

[11] Patent Number: 4,869,043

[45] Date of Patent: Sep. 26, 1989

[54] SHEAR CONNECTOR

[75] Inventors: Michael A. Hatzinikolas; Robert M. Pacholok, both of Edmonton, Canada

[73] Assignee: Fero Holdings Ltd., Canada

[21] Appl. No.: 227,527

[22] Filed: Aug. 2, 1988

[51] Int. Cl.[4] ..... E04B 1/41

[52] U.S. Cl. ..... 52/712; 52/379; 52/383; 52/428

[58] Field of Search ..... 52/712–714, 52/378–383, 351, 434, 428, 416, 407–409, 442

[56] References Cited

U.S. PATENT DOCUMENTS

| | | | |
|---|---|---|---|
| 543,014 | 7/1895 | Hanna | 52/714 |
| 1,832,231 | 11/1931 | Menninger | 52/714 |
| 2,097,069 | 10/1937 | Klages | 52/766 |
| 2,261,510 | 11/1941 | Atcheson | 52/442 |
| 2,293,743 | 8/1942 | Miles et al. | 52/409 |
| 3,217,457 | 11/1965 | Naar | 52/714 |
| 3,353,312 | 11/1967 | Storch | 52/713 |
| 4,329,821 | 5/1983 | Long et al. | 52/410 |
| 4,373,314 | 2/1983 | Allan | 52/434 |

FOREIGN PATENT DOCUMENTS

| | | | |
|---|---|---|---|
| 188895 | 2/1957 | Austria | 52/383 |
| 559578 | 3/1957 | Italy | 52/428 |
| 622156 | 4/1949 | United Kingdom | 403/300 |

*Primary Examiner*—James L. Ridgill, Jr.
*Attorney, Agent, or Firm*—Irell & Manella

[57] ABSTRACT

A tie assembly is used in a cavity wall having a back-up wall and a brick veneer to secure the brick veneer to the back-up wall. The tie assembly includes a plate that is secured to the back-up wall in a vertical orientation, with an tying portion of the plate projecting towards the brick veneer. A series of tie openings are spaced along the outer edge of the plate to receive a tie bar that projects into the mortar between adjacent brick courses. The tie bar cooperates with the plate to transmit loads oriented in any direction in the plane of the plate between the brick veneer and the back-up wall. This means that shear loadings as well as lateral loads are transmitted between the veneer and the back up wall, so that the two act as a truss structure.

20 Claims, 5 Drawing Sheets

SHEAR CONNECTOR

FIELD OF THE INVENTION

The present invention relates to a tie assembly for cavity walls and more particularly to a tie assembly for tying a brick or the like veneer to a back-up wall.

BACKGROUND

With modern construction techniques, the brick exterior cladding applied to buildings is used primarily for aesthetic purposes. Its sole functional purpose is to prevent moisture from coming into contact with interior components of the wall.

The present invention is concerned with providing a wall of this general sort where the brick veneer is used as a structural component to resist lateral loads. The invention accomplishes this through the use of a novel tie assembly that joins the back-up wall and the veneer so as to transmit shear loads therebetween.

SUMMARY

According to one aspect of the present invention there is provided a tie assembly for a cavity wall having a back-up wall and a brick veneer separated by a cavity, said assembly comprising:

a plate having an inside anchoring portion with a plurality of fastener openings threein, said fastener openings being sized and located to receive fasteners for securing the plate in a substantially vertical orientation to the back-up wall;

a tie engagable between courses of the brick wall to project into the cavity; and a tie engaging means on an outside tying portion of the plate for engaging the tie and preventing substantial relative movement between the tie and the plate in the plane of the plate.

With a tie assembly of this sort, the back up wall and the veneer are anchored one to the other to provide a truss-like structure in which the back-up wall and the veneer jointly resist lateral loading. This reduces the loads on the back-up wall, so that its strength can be reduced, lowering the overall cost of the wall. Another benefit of using a shear connector according to the invention is the reduction in veneer deflections, which minimizes cracking and water penetration.

According to another aspect of the present invention, there is a provided a cavity wall incorporating such a tie assembly.

BRIEF DESCRIPTION OF THE DRAWINGS

In the accompanying drawings, which illustrate exemplary embodiments of the present invention.

DETAILED DESCRIPTION

Figure 1:
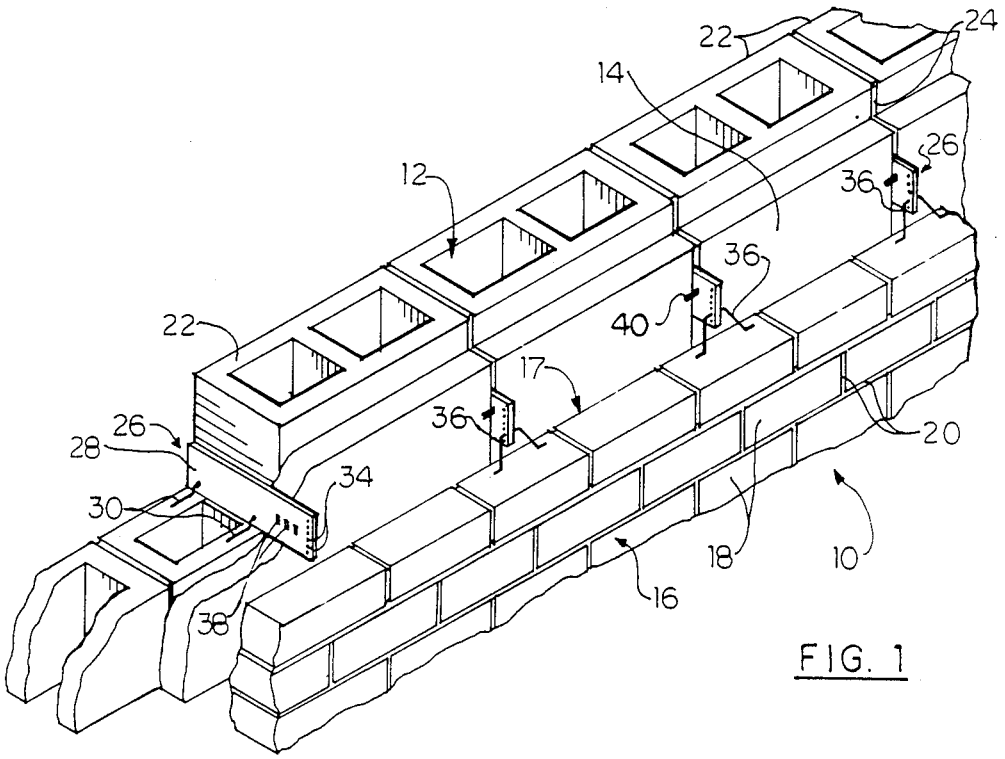
FIG. 1 is an isometric view of a wall, partly broken away, incorporating ties according to the present invention.
Figure 2:
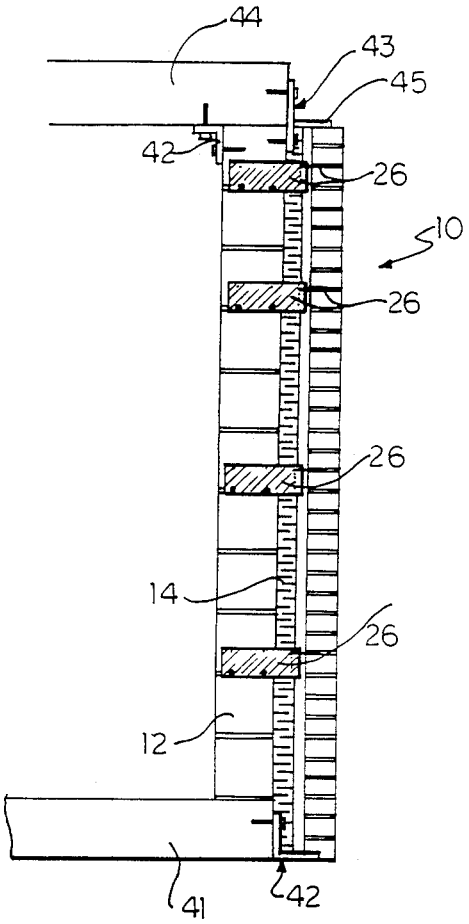
FIG. 2 is side elevation of the wall of FIG. 1.

Referring to the accompanying drawings and particularly FIGS. 1 and 2, there is illustrated a wall 10 consisting of a back-up wall 12 covered with insulating panels 14 and faced with a brick veneer 16 located at some distance from the insulation to provide a cavity 17 therebetween. The brick veneer 16 is a conventional brick veneer composed of bricks 18 and mortar 20. The back up wall in this embodiment is formed from concrete blocks 22 with mortar joints 24.

The back-up wall 12 and the brick veneer 16 are joined by a plurality of tie assemblies 26. Each tie assembly includes a flat rectangular plate 28, vertically oriented, with an anchoring portion embedded in mortar between two concrete blocks 22 in one course. The anchoring portion of the plate 28 has a pair of cross legs 30 extending laterally through fastening openings 32 in the plate and embedded in the mortar between two courses of concrete blocks 22. The cross legs firmly bond the plate to the back up wall.

Along the outer edge of the plate 28 is a series of tie openings 34. They accommodate a V-shaped tie bar 36 that has its legs embedded in the mortar between two courses of bricks 18.

The plate 28 is also provided with a series of retainer openings 38 that accommodate a wedge-shaped retainer 40 to retain the insulation panels 14 against the outer face of the back up wall 12.

Figure 3:
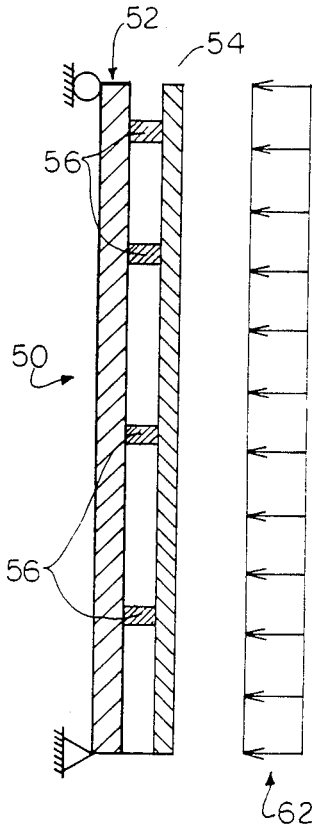
FIG. 3 is a schematic representation of the effective truss provided by the wall structure of FIGS. 1 and 2.
Figure 4:
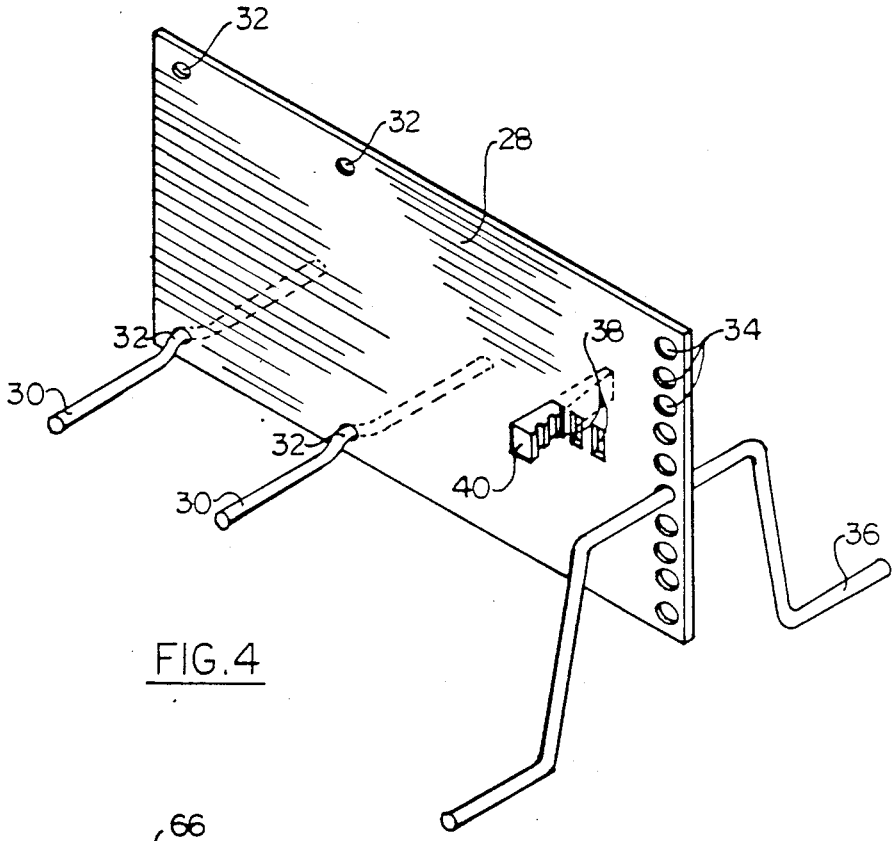
FIG. 4 is an isometric view of a tie according to the present invention.

Referring to FIGS. 2 and 3, the back-up wall is typically supported on a floor slab 41. At the top, it is retained against lateral displacement by two intermediate lateral supports 42 and 43 secured to the next highest floor slab 44. A flange 45 on the lateral support 43 extends over the top of the insulating panels, the wall cavity 17 and at least part of the brick veneer 16. At the bottom, a support 46 secured to the floor slab 41 supports the brick veneer. The tie assemblies 26 join the veneer and the back-up wall at spaced points to produce an effective truss structure as illustrated schematically in FIG. 3.

Referring to FIG. 3, the truss 50 has an inner member 52, an outer member 54 and shear legs 56 joining the two. The inner member is supported against lateral deflection at its upper and lower ends.

A lateral loading on the wall, such as the loading schematically represented at 62, causes the composite wall structure to act as a truss, with the inner member 52 acting as the tension member and the outer member 54 as the compression member. In a physical wall, a loading of this sort may be caused, for example, by winds or earthquakes.

In conventional cavity walls, the brick veneer is tied to the back-up wall with ties that will not sustain a shear loading, so that this effective truss structure is not provided. In the absence of the truss, the back-up wall sustains all of the lateral loads and must therefore be much stronger than is the case where the brick veneer contributes to lateral load resistance.

For leeward wind loads, that is loads acting in the opposite direction from that illustrated at 62 in FIG. 3, the brick veneer serves as a tension member, while the back-up wall acts as a compression member.

The detailed configuration of the tie assembly is illustrated in FIGS. 4 through 8. The plate 28 is of rectangular form and has the four fastening openings 32 arranged in a rectangular array, with two openings adjacent the top edge and two openings adjacent the bottom edge. Eleven tie bar openings 34 are spaced along the outermost edge of the plate, while three rectangular retainer openings 38 are located generally centrally between the top and bottom edges of the plate and spaced along the plate between the outer tying portion and the inner anchoring portion.

Figure 5:
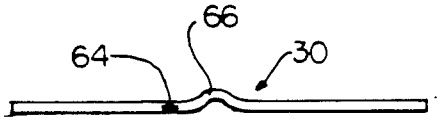
FIG. 5 is an isometric view of a cross leg.
Figure 6:
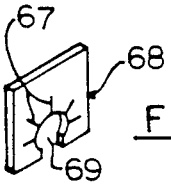
FIG. 6 is an isometric view of a leg lock.

The cross legs 30 are illustrated most particularly in FIG. 5. Each is a round bar with a v-shaped offset 66 at the centre and a crimp 64 to one side of the offset. The crimp in the tie bar is configured so that it cannot pass through the fastening opening 32. A leg lock 68 of the cross leg is illustrated in FIG. 6. This is a square of stiff material with a circular opening 69 adjacent one edge and a series of radial slits 67 projecting from the radial opening. The leg lock may be flexed to fit over that portion of the cross leg 30 adjacent the offset 66, on the side of plate 28 opposite the crimp 64. Thus, the crimp and the leg lock will cooperate to retain a cross leg in position when it is installed through a fastening opening with the offset 66 in the centre position.

Figure 7:
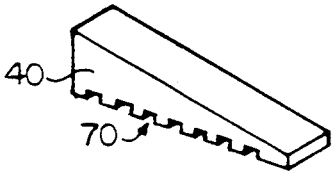
FIG. 7 is an isometric view of a wedge.
Figure 8:
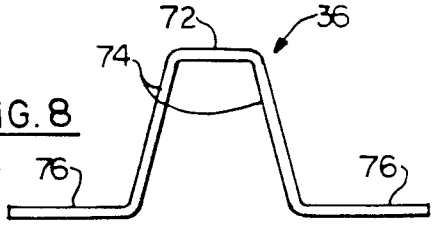
FIG. 8 is an isometric view of a tie bar.

The wedge retainer 40 as illustrated most particularly in FIG. 7. This is a wedge-shaped bar with a smooth inner face that engages the insulating panel and a serrated outer face 70 that serves to grip the confronting edge of the retainer opening 38 to prevent unwanted displacement of the retainer 40 out of the opening 38.

The tie bar 36 is generally v-shaped, with a bight 72, divergent legs 74 and oppositely projecting leg end sections 76. In the installed condition of the tie bar, the bight 72 is centered in one of the tie openings 34 and the legs and leg ends are seated in the mortar between two courses of brick. In other embodiments, other forms of tie can be used, provided a good key to the adjacent mortar is maintained.

Figure 9:
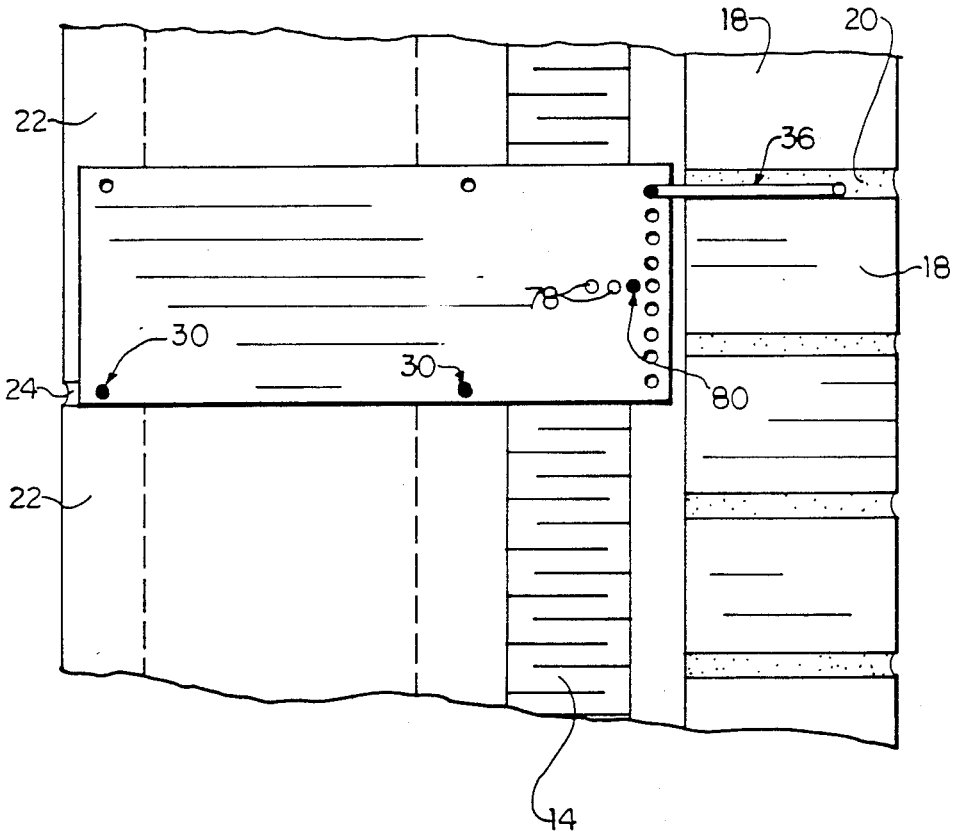
FIG. 9 is a detailed view showing the connection of a tie in a wall like that of FIGS. 1 and 2.

FIG. 9 illustrates the installation of the tie assembly in a cavity wall with an insulation layer and a concrete block back-up wall. The cross legs 30 pass through the bottom fastening openings 32 and are seated in a layer of mortar 24 between two concrete blocks 22. The triangular tie bar 36 extends from the uppermost tie opening 34 directly into the mortar 20 between two courses of bricks 18. In installing the structure, the tie bar is inserted in whichever of the tie openings 34 that will provide this relationship.

In this embodiment, the retainer openings 78 are circular and a circular pin 80 serves as the insulation retainer, retaining the layer of insulation 14 against the concrete block back-up wall. Where desired, the cores of the concrete block can be reinforced and/or grouted to improve the performance of the entire system.

Figure 10:
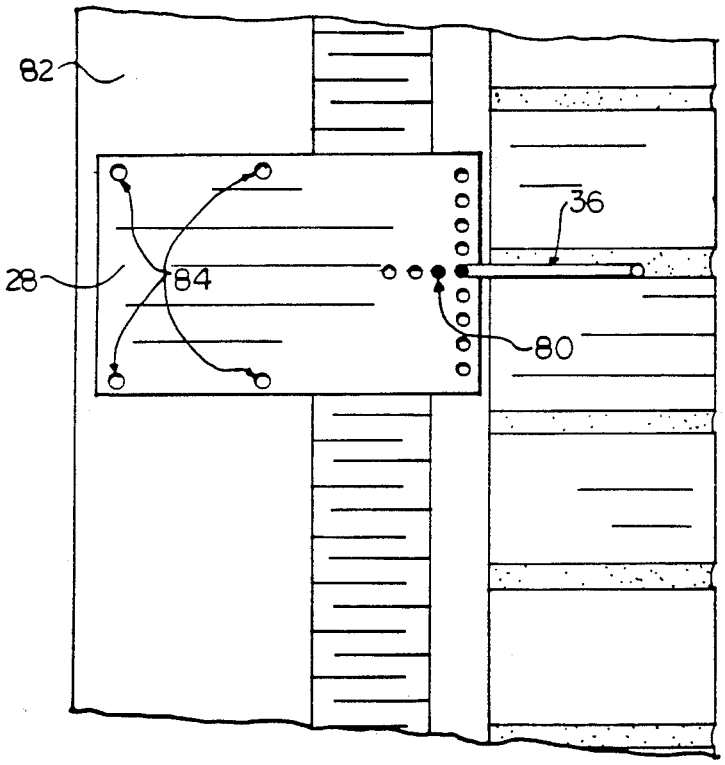
FIG. 10 is a view like FIG. 9 showing the use of the tie in connection with a stud back up wall.

FIG. 10 illustrates the use of a tie assembly similar to that in FIG. 9 for securing a brick veneer to a stud wall. In this case, the plate 28 is secured to a wooden stud 82 by four nails 84 through the fastening openings 32.

Where metal studs are used, the nails will be replaced by appropriate screws or other fasteners.

While particular embodiments of the present invention have been described in the foregoing, it is to be understood that other embodiments are possible within the scope of the present invention. For example, the shape and dimensions of the plate 28 may vary widely according to the strength, wall dimensions and other physical characteristics of the particular application. The tie bars 36 may also vary in form, provided only that the key to the mortar 20 between the bricks is adequate to transmit to the plate loadings in all orientations within the plane of the plate. Thus, the invention is to be considered limited solely by the scope of the appended claims.

We claim:

1. A tie assembly for a cavity wall having a vertical back-up wall and a vertical brick veneer separated by a cavity, said assembly comprising:

a plate having an inside anchoring portion with a plurality of fastener openings therein, and an outside tying portion;

a tie bar with a bight and two legs projecting to one side of the bight for engagement between courses of the brick veneer; and a tie bar engaging means on the outside tying portion of the plate engaging the centre section of the tie bar and preventing substantial relative movement between the tie bar and the plate whereby:

when the anchoring portion of the plate is secured to the back-up wall with fasteners through the fastener openings and the legs of the tie bar are engaged between courses of the brick veneer, shear forces will be transmitted between the back-up wall and the brick veneer.

2. An assembly according to claim 1 wherein the tie bar engaging means comprise a tie bar opening adjacent an edge of the plate receiving the tie therethrough.

3. An assembly according to claim 2 comprising of a row of tie openings adjacent said edge of the plate.

4. An assembly according to claim 1 wherein the fastener openings comprise four openings in a rectangular array, with two fastener openings adjacent a top edge of the plate and two fastener openings adjacent a bottom edge of the plate.

5. An assembly according to claim 4 including a plurality of cross legs adapted to be received in the fastener openings to project to either side of the plate for engagement between courses of a block back-up wall.

6. An assembly according to claim 5 wherein each cross leg is a rod.

7. An assembly according to claim 6 including a crimp in the cross leg adjacent the centre thereof, the crimp presenting a rod cross-section that will not pass through the fastener openings.

8. An assembly according to claim 6 including a leg lock engageable with a cross leg and having a size larger than the cross sectional size of each fastener openings so as to prevent the removal of the cross leg from a fastener opening.

9. An assembly according to claim 1 including insulation retaining means for retaining an insulating panel against the back-up wall.

10. An assembly according to claim 9 wherein the insulation retaining means comprise at least one retainer aperture through the plate between the fastener openings and the tie engagement means, and a cross member engagable through the retainer aperture.

11. An assembly according to claim 10 including a plurality of retainer apertures spaced between the anchoring and tying portions of the plate.

12. An assembly according to claim 11 wherein the retainer apertures are rectangular.

13. An assembly according to claim 12 wherein the cross member is a wedge.

14. An assembly according to claim 13 wherein the wedge has a serrated face.

15. An assembly according to claim 11 wherein the retainer apertures are circular.

16. An assembly according to claim 15 wherein the cross member is a pin.

17. A wall comprising:

a substantially vertical back-up wall;

a substantially vertical brick veneer spaced from and parallel to the back-up wall to define a cavity between the brick veneer and the back-up wall;

a plate having an inside anchoring portion and a vertically oriented tying portion projecting into the cavity towards the brick veneer;

fastening means securing the inside anchoring portion of the back-up wall and preventing relative movement of the anchoring portion and the back-up wall;

a tie bar secured to the brick veneer between courses thereof and projecting from the veneer into the cavity; and a tie bar engaging means securing the tie bar to the tying portion of the plate, in the cavity, preventing relative movement of the tie bar and the tying portion of the plate, whereby shear forces are transmitted between the back-up wall and the brick veneer.

18. A wall according to claim 17 wherein the anchoring portion of the plate comprises fastening openings therethrough and including fasteners extending through said openings and securing the plate to the back up wall.

19. A wall according to claim 17 wherein the tying portion of the plate comprises a tie opening through the plate and the tie comprises a rod with a bight extending through said tie opening and divergent legs projecting into the brick veneer.

20. A tie according to claim 17 including a layer of insulation on the back-up wall, in the cavity, and a cross member secured to the plate, projecting therefrom and securing the layer of insulation against the back-up wall.

* * * * *